US005334818A

United States Patent [19]

Edwards et al.

[11] Patent Number: 5,334,818

[45] Date of Patent: Aug. 2, 1994

[54] MODULAR HIGH DENSITY ELECTRIC HEATING ELEMENT ARRANGEMENT FOR AN AIR FLOW HEATER

[75] Inventors: Gary C. Edwards; Ronald H. Schaefer, both of Winnipeg, Canada

[73] Assignee: Temro Division, Budd Canada Inc., Winnipeg, Canada

[21] Appl. No.: 846,873

[22] Filed: Mar. 6, 1992

[51] Int. Cl.[5] ..... H05B 1/02; H05B 3/02; F24H 1/10; H01C 00/00

[52] U.S. Cl. ..... 219/539; 219/537; 219/541; 219/550; 219/551; 338/58; 338/301; 338/321; 392/347; 392/360; 392/365; 392/373; 392/379

[58] Field of Search ..... 392/360-373, 392/379-385, 347-350; 338/298, 296, 301, 295, 286, 299, 58, 321; 219/536, 537, 539, 546, 550, 551, 541

[56] References Cited

U.S. PATENT DOCUMENTS

| | | | |
|---|---|---|---|
| 1,014,662 | 1/1912 | Momnot | 392/373 |
| 1,491,194 | 4/1924 | Burger | 392/350 |
| 1,957,227 | 5/1934 | Reimers et al. | 338/299 |
| 4,122,329 | 10/1978 | Godel | 219/551 X |
| 4,163,146 | 7/1979 | Meywald | 219/532 X |

FOREIGN PATENT DOCUMENTS

| | | | |
|---|---|---|---|
| 3041349 | 6/1982 | Fed. Rep. of Germany | 392/379 |

OTHER PUBLICATIONS

Pp. 23 to 38 from a book entitled "Kanthal Handbook-Resistance Heating Alloys for Appliances and Heaters".

Brochure entitled "The Most Advanced Heating Elements-In the World" by Hartford Eichenauger Inc.

*Primary Examiner*—Anthony Bartis

*Attorney, Agent, or Firm*—Adrian D. Battison; Stanley G. Ade; Murray E. Thrift

[57] ABSTRACT

A heating element for an air flow comprises a channel shaped bracket including a base and side walls at right angles thereto within which is mounted a pair of mica sheets arranged parallel to the base and at right angles to the sides and connected to the sides by ribs longitudinally of the sides with transverse slots within which the sheets slide. Each sheet is wrapped with a heating wire formed into helical coils so that each side of the sheet carries a plurality of parallel helical coil portions with connecting portions wrapped over the edges of the sheet. The sheets are symmetrical and one is inverted relative to the other. Each sheet carries at ends thereof a male and a female connector of the blade and receptacle type so that the blade of one sheet engages into the receptacle of the other sheet. The connectors thus provide mechanical support to hold the sheet in spaced position and in addition provide electrical connection across the sheets so that electrical energy from supply wires is connected in parallel across the wires of the two sheets. The structure is simple to manufacture and provides a structurally rigid arrangement with high wire density leading to reduced wire temperature.

20 Claims, 4 Drawing Sheets

MODULAR HIGH DENSITY ELECTRIC HEATING ELEMENT ARRANGEMENT FOR AN AIR FLOW HEATER

BACKGROUND OF THE INVENTION

This invention relates to a heating element for an air flow heater.

Air flow heaters are used in many situations for example as hair dryers, space heaters, interior car warmers. In many cases the heating element which is located in the air stream generated by a fan of the heating device comprises a coiled electrical resistance heating wire which is supported by non conductive support sheets often of ceramic or mica.

Various different designs have been proposed but the most common design comprises three vertical baffles arranged generally parallel to the air flow with two of the baffles arranged at ends of the air flow and a central one of the baffle arranged between the two end baffles. The helical coils are then strung across between the baffles and supported thereby so that the axis of the coils is transverse to the air flow. This arrangement has been manufactured widely and can be manufactured relatively cheaply particularly where labour costs are relatively low. However this arrangement has a number of disadvantages. Firstly the amount of heating wire that can be supported across the air flow is relatively low thus leading to a relatively low density of wire so that the heat of the wire or the watts per unit length of the wire must be relatively high. This leads to a high temperature of the wire which reduces wire life and increases radiant heat from the wire which can cause damage to the surrounding plastics housing. The second disadvantage is that the wire must be supported by a central baffle between the two end baffles which interferes with the air flow across the wire element thus generating areas of reduced air flow which cause hot spots in the wire again reducing wire life and increasing the danger of damage from radiant heat.

SUMMARY OF THE INVENTION

It is one object of the present invention, therefore, to provide an improved arrangement of heating element for an air flow heater.

According to a first aspect of the invention there is provided a heating element for heating an air flow passing thereover comprising a first substrate sheet and a second substrate sheet each formed of an electrically non conductive material and defining a first side, a second opposed side, a first side edge, a second opposed side edge, a first end and a second opposed end. Each substrate sheet has wound generally therearound a continuous electrical resistance heating wire, the wire being shaped so as to form a plurality of separate generally parallel helical coils on the first side of the sheet, a plurality of separate generally parallel helical coils on the second side of the sheet and a plurality of interconnecting portions. Each helical coil extends from a position adjacent one side edge to a position adjacent the second side edge. Each end of a helical coil on the first side is connected by a respective one of the interconnecting portions to a respective one of two helical coils on the second side. Connecting means support the first and second substrate sheets in substantially parallel spaced generally overlying relation with the first side of the first sheet facing the first side of the second sheet such that the helical coils on the first side of the first sheet are adjacent to but spaced from the helical coils on the first side of the second sheet so as to allow the passage of the air flow therebetween. The connecting means are arranged to provide both electrical connection between the heating wire of the first sheet and the heating wire of the second sheet and mechanical support between the first and second sheets.

According to a second aspect of the invention there is provided a heater comprising a fan for generating an air flow, and a heating element mounted so as to receive the air flow passing thereover.

The heating element comprises a first substrate sheet and a second substrate sheet each formed of an electrically non conductive material and defining a first side, a second opposed side, a first side edge, a second opposed side edge, a first end and a second opposed end. Each substrate sheet has wound generally therearound a continuous electrical resistance heating wire, the wire being shaped so as to form a plurality of separate generally parallel helical coils on the first side of the sheet, a plurality of separate generally parallel helical coils on the second side of the sheet and a plurality of interconnecting portions. Each helical coil extends from a position adjacent one side edge to a position adjacent the second side edge. Each end of a helical coil on the first side being is connected by a respective one of the interconnecting portions to a respective one of two helical coils on the second side. Connecting means support the first and second substrate sheets in substantially parallel spaced generally overlying relation with the first side of the first sheet facing the first side of the second sheet such that the helical coils on the first side of the first sheet are adjacent to but spaced from the helical coils on the first side of the second sheet so as to allow the passage of the air flow therebetween. The connecting means are arranged adjacent said ends of the sheets outwardly beyond endmost ones of the helical coils such that an area between the sheets at the helical coils is free from elements between the sheets causing restriction of the airflow therebetween.

The arrangement of the present invention provide a number of advantages.

Firstly the first and second sheets can be modular in form that is they are substantially symmetrical providing a manufacturing advantage so that each sheet is substantially equal to the next adjacent sheet.

Secondly the construction of the wrapped helical coils together with the close support of the helical coils by the sheets allows the helical coils between the sheets to be closely positioned allowing more wire in a unit volume. This reduces the watt density and can allow the heating coil to run in the black heat condition without reaching red hot temperatures or localized red hot spots.

The construction allows variable density of turns within the helical coils to accommodate difference volumes or velocities of air flow across the length of the sheets from one end to the other end.

Thirdly the male and female connectors allow direct simple mechanical connection between the sheets to provide both the spacing and electrical connection without the necessity for insulation materials on connecting wires.

The construction can provide support for the two sheets which is arranged solely at the ends of the sheets so that there is no central partition between the sheets which would interfere with air flow.

The modular and symmetrical construction of the sheets can allow the automation of the manufacture process since the wrapping around the outside of the sheets does not require manual dexterity for threading.

BRIEF DESCRIPTION OF THE DRAWING

One or more embodiments of the invention will now be described in conjunction with the accompanying drawings.

DETAILED DESCRIPTION

Figure 1:
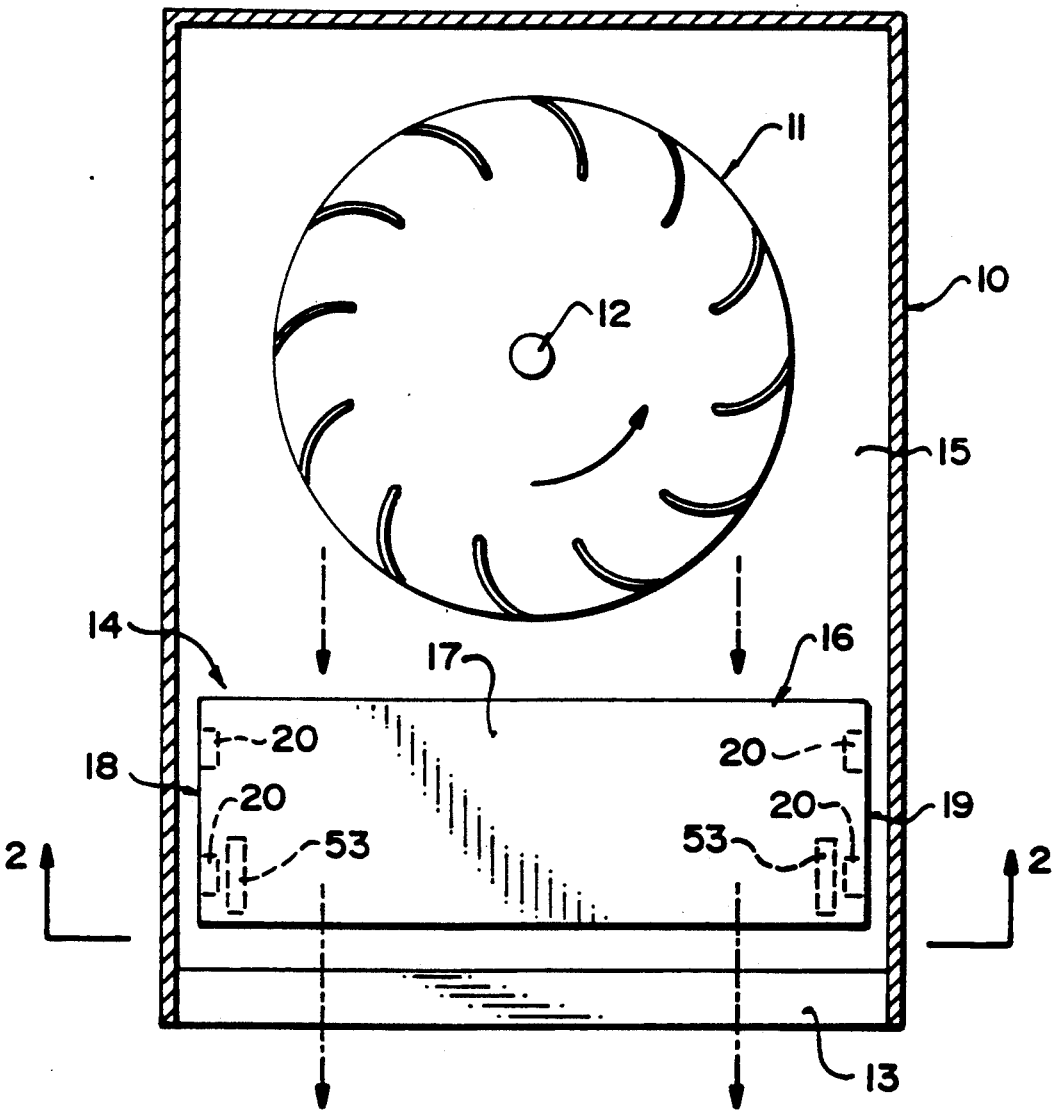
FIG. 1 is a cross sectional view through an air flow heater according to the present invention.
Figure 2:
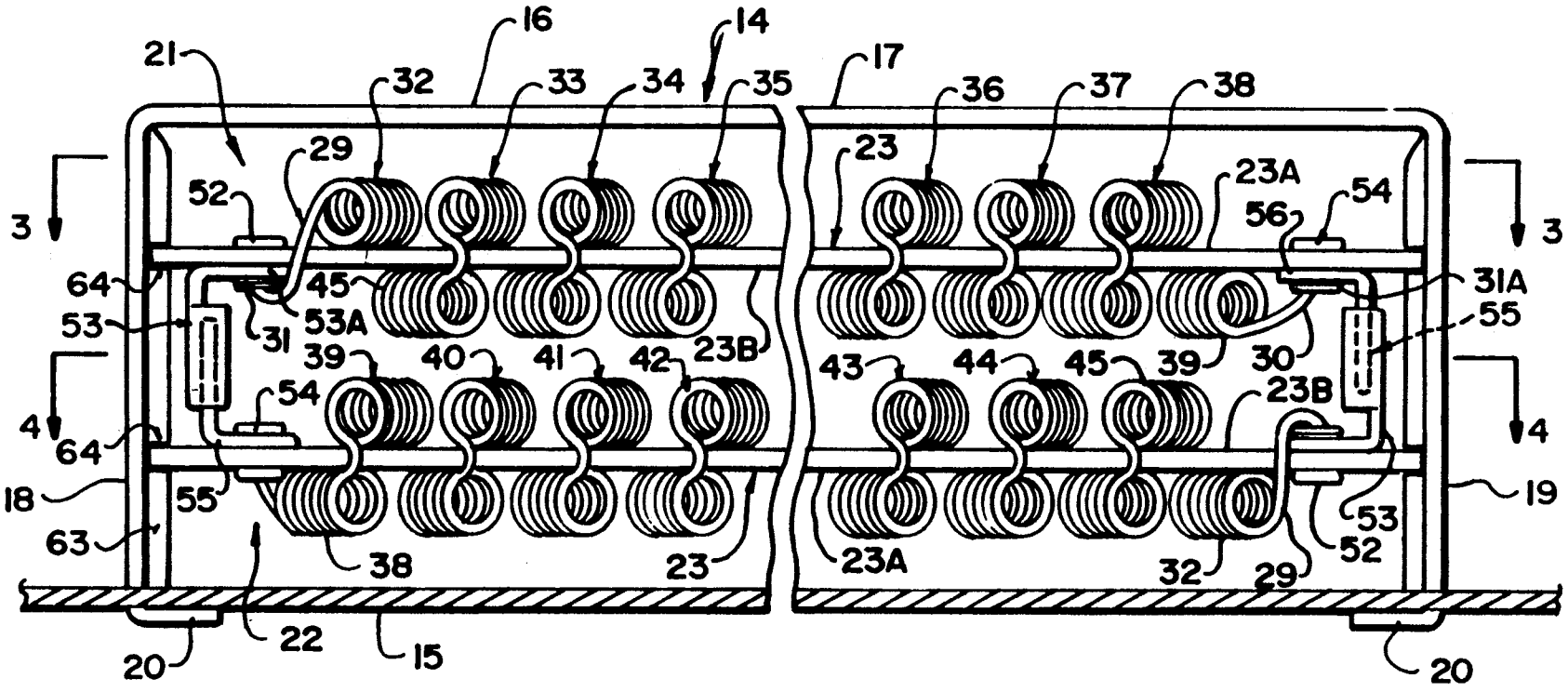
FIG. 2 is a view along the lines 2—2 of FIG. 1 showing the heater element construction.

The heater assembly shown in FIG. 1 includes an outer housing 10 which is shown only schematically as this can be shaped and arranged in many different ways in accordance with the knowledge of one skilled in the art. The housing includes a fan 11 mounted for rotation about an axle 12 so that air is drawn from the underside (not shown) of the fan and expelled radially outwardly into the housing. The forward end of the housing includes a nozzle 13 again shown only schematically. Just inside the nozzle within the housing is mounted a heating assembly generally indicated at 14 and shown in more detail in FIGS. 2, 3 and 4. The heating assembly is arranged so that the air from the fan passes over heating, elements of the heating assembly before exiting from the housing through the nozzle 13. The housing includes a main plate 15 which extends longitudinally of the housing, provides support for the motor (not shown) and the axle 12 of the fan, defines a surface over which the air is constrained to pass and also provides support for the heating assembly as best shown in FIG. 2.

The heating assembly includes a channel member 16 including a substantially flat base plate 17 and a pair of sides 18 and 19 arranged at right angles to the base plate 17 so as to extend therefrom to the main plate 15. Thus the base plate 17 is supported at a position parallel to but spaced from the main plate 15 defining a rectangular area therebetween for receiving the heating element. The edges of the side plates 18 and 19 at the main plate 15 include a pair of tabs 20 which project downwardly through suitable openings in the main plate and are crimped over to unite the channel member 16 and the main plate 15 as an integral structural member.

The heating element comprises a first element portion 21 and a second element portion 22 which are coupled together mechanically and electrically and supported inside the space defined by the channel member 16 and the main plate 15.

Figure 3:
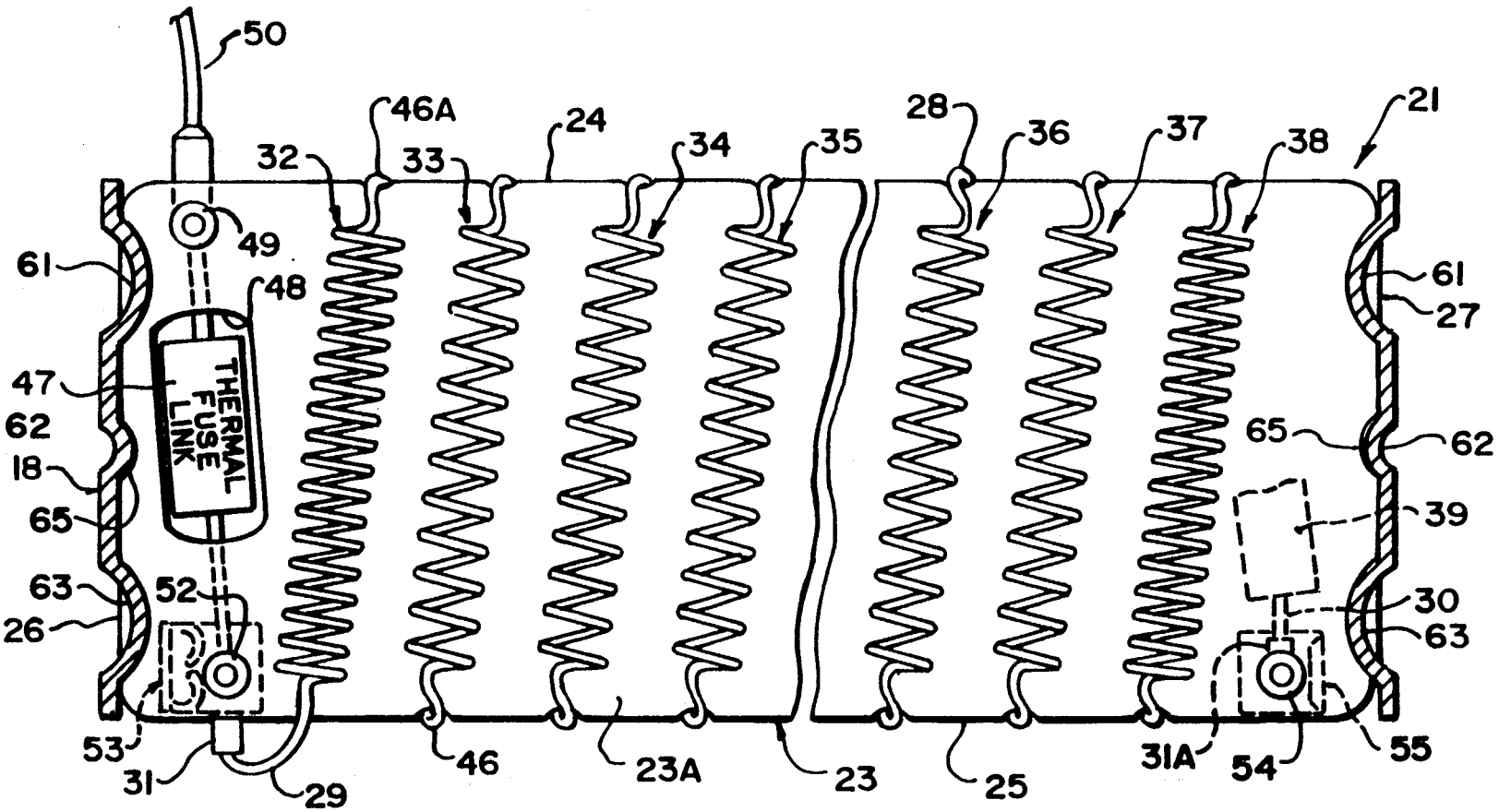
FIG. 3 is a cross sectional view along the lines 3—3 of FIG. 2.
Figure 4:
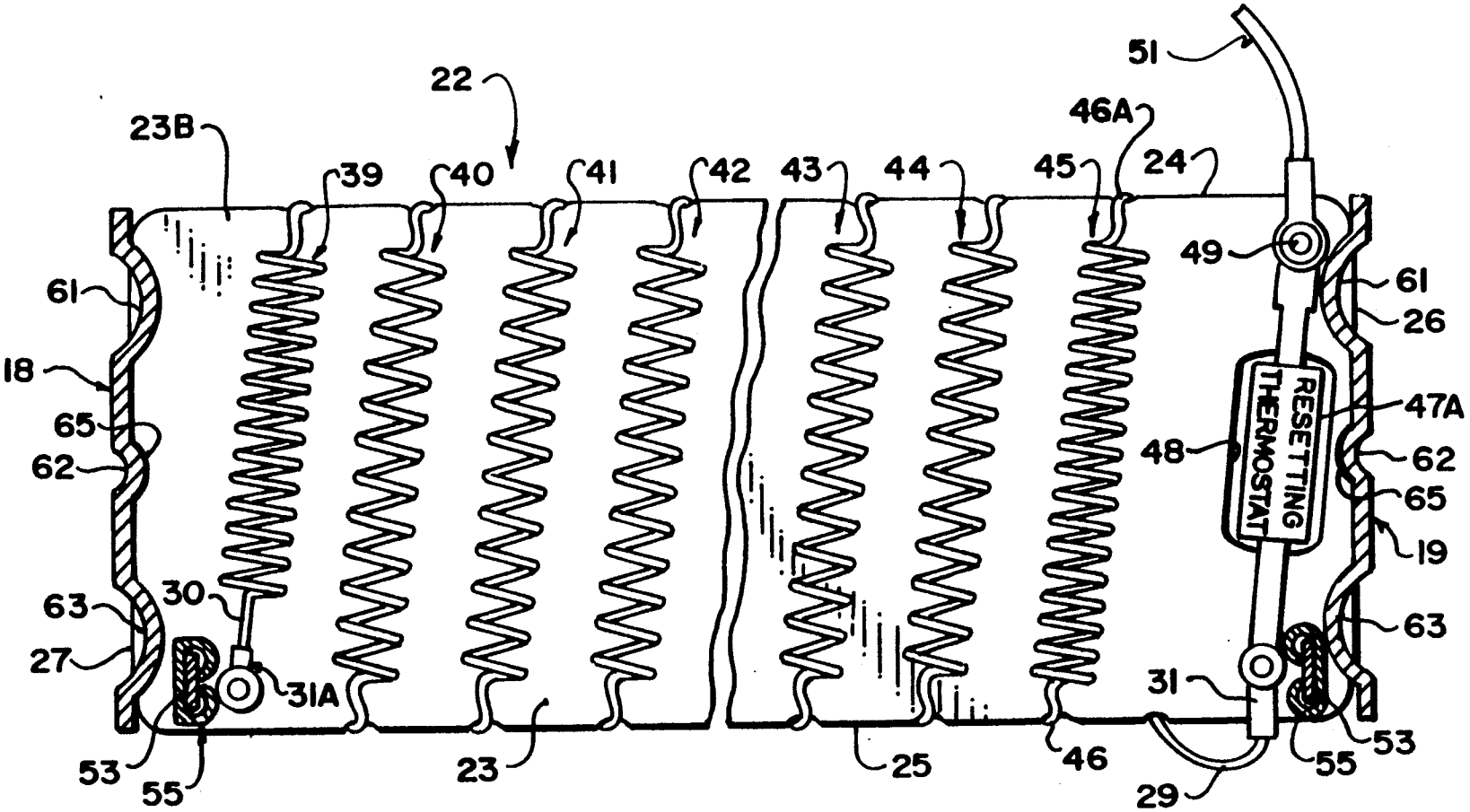
FIG. 4 is a cross sectional view along the lines 4—4 of FIG. 2.

Each of the element portions 21 and 22 is substantially symmetrical, that is when disconnected and placed side by side the arrangements are substantially identical. This allows the two elements to be manufactured effectively as a single part type in a mass production process. When connected together, however, one of the portions is inverted relative to the other so that the similar surfaces face in towards one another as explained in more detail hereinafter. Thus the view shown in FIG. 3 shows the outer side of the portion 21 and the view of FIG. 4 shows the inner side of portion 22. As these portions are substantially identical, FIGS. 3 and 4 combined will show the full construction of one of the portions.

Turning therefor to describe one of the portions, that portion comprises a flat sheet 23 of mica or similar non electrically conductive material acting as an insulating support for the heating element wire. The sheet is flat and rectangular so as to define an upper surface 23A and a lower surface 23B, a first side edge 24, a second opposed side edge 25, a first end 26 and a second end 27 opposed to the first end. The mica sheet is sufficiently rigid to be self supporting to provide mechanical support for the heating element wire.

The heating element wire is initially formed into a continuous helical structure formed of an integral electrical resistance wire so that voltage applied across the ends of the wire will cause current to flow through the wire to generate heat in conventional manner. Thus the initial condition of the heating wire is a continuous helical coil extending from a first end 29 to a second end 30 of the wire. Each end is attached to a crimp type connector 31, 31A attached to the board as described hereinafter. The continuous coil is then divided into a plurality of separate coil portions which are indicated at 32 through 38 on one side 23A of the mica sheet and 39 through 45 on an opposed side 23B of the mica sheet. The end 29 of the wire extends from the crimp type connector 31 on the side 23B of the sheet to a first one of the coil portions 32 on the side 23A of the sheet. The portion that wraps around the edge 25 of the sheet is defined by one turn of the helical coil. The helical coil portion 32 extends across the side 23A substantially from one edge to the opposed edge and arranged with the axis of the coil at a slight angle to a direction at right angles to the side edges 25 and 24 so that the coil axis is arranged at an angle to the direction of air flow. At the edge 24, an interconnecting portion 46A defined from one helical turn is distorted so as to wrap over the edge 24 and connect the coil portion 32 to the coil portion 45. The coil portion 45 is mounted on the side 23B and similarly extends with the coil axis at a slight angle to the direction transverse to the sheet. The other end of the coil portion 45 includes a connector wire portion 46 which wraps around the edge 25 of the sheet and connects to the next adjacent coil portion 33 on the side 23A. As shown the coil portions on side 23 are parallel and substantially equidistantly spaced with the space being suitable for the most effective coil density to provide the most effective heating.

It will be noted that the coil turn spacing is increased in relation to the coil portions adjacent a centre part of the sheet relative to the spacing of the coil portions adjacent the side edges of the sheet. Thus the coil portions 40, 41, 42, 43 and 44 (FIG. 4) have less turns from the coil portions 39 and 45. This provides an increased coil density at the sides in view of a measured difference in air flow which occurs at the sides. Thus an increased air flow at the sides provides a greater cooling effect or heat extraction from the coil portions 39 and 45 at the sides so that more heat can be supplied at the sides while retaining the wire at a substantially constant temperature along its full length.

At the end 29 of the wire is connected a thermal circuit interrupter 47, 47A. The interrupter 14 is mounted within a hole 48 formed in the mica sheet so that the interrupter is exposed to both sides of the mica sheet to be receptive to heat in the area of both mica sheets with the interrupter spanning the hole and connected between the connector 31 at the end 29 and a connector 49 at one corner of the sheet.

The only difference between the element portion 21 and 22 is that the interrupters 47 and 47A are different. Thus it will be noted that FIG. 3 is not an exact reversal of FIG. 4 but the two interrupters 47 and 47A are illustrated differently. Both of these interrupters are of a well known and conventional type and do not need to be described in detail. However it will be noted that the interrupter 47 is of the type known as a fusible link which breaks permanently on detection of heat beyond a predetermined absolute maximum temperature. The interrupter 47A is of a resettable type thermostatic switch generally being of the bimetal strip arrangement so that it is automatically reset when the temperature falls below the break temperature. Thus the interrupters cooperate so that normally in the event of a temperature rise the thermostatic switch 47A will first trip when the temperature exceeds a predetermined working temperature. If the thermostatic switch 47A fails then the fusible link 47 will permanently break to prevent possible fire damage.

The connector 49 of the element portion 21 is on the left hand side as illustrated in FIG. 3 and is connected to a supply wire 50. The connector 49 of the element 22 is provided on the right hand side as shown in FIG. 4 due to the inversion of one portion relative to the other portion and is connected to a second supply wire 51. The wires 50 and 51 thus provide a voltage across the heating element which is applied to the wire elements of the portions 21 and 22 in parallel as explained hereinafter. The voltage can be either a mains voltage or can be a 12 volt voltage of a vehicle system but in any event is arranged to provide a heating temperature of the wire sufficient to heat the air to a required temperature.

As best shown in FIG. 2 the heating element portion 21 has attached thereto at the end 29 of the wire a rivet 52 which attaches the terminal 31 to the sheet. At the same time the rivet attaches a female connector 53 of a conventional blade type electrical connector to the sheet by a flange 53A along the sheet with the female portion extending at right angles to the sheet.

At the end 30 of the wire, the connector 31A is similarly attached to the sheet by a rivet 54 which again attaches a male portion of a blade type connector 55 to the sheet. The male portion includes a flange 56 attached to the sheet and the blade portion extending outwardly at right angles from the sheet.

As best shown in FIG. 2, the second element portion 22 has exactly the same construction arranged in a directly symmetrical manner. Thus when one of the element portions is inverted relative to the other, the male blade 55 of one is brought into engagement with the female receptacle 53 of the other so that these can be pressed together in the conventional snap fastening arrangement. These connectors therefore provide both a mechanical fastening of the element portions together and also an electrical connection between the ends of the wires. The length of the connectors is arranged so that the sheets of the two element portions are arranged at a required spacing to hold the helical coils on the inside between the two sheets at a required spacing sufficient to allow airflow therebetween and over the coils.

It will be noted from FIGS. 3 and 4 that the male and female connector elements are arranged at the edge 25 and on either side of the sheet adjacent the ends 26 and 27. Thus the mechanical support for the two element portions is arranged substantially wholly outside the area within which the heating element is located. There is thus no interference with the air flow passing between the two sheets which is then free to pass over the heating elements in a uniform manner without dead spots which can cause local excessive heating of the wire.

From a review of the drawings, it will be noted that the supply from the wire 50 is connected to the end 29 of the wire on the heating element portion 21 and through the connector 53, 55 to the end 30 of the wire on the heating element portion 22. Thus the wires are connected in parallel with the energy from the wire 50 passing through both wires in parallel to the symmetrical arrangement at the end 51. The thermal circuit interrupters are thus positioned at the connection to the wire 50 and to the wire 51 thus providing protection in both directions.

As shown in FIGS. 3 and 4, the side walls 18 and 19 of the bracket 16 are punched to form three ribs 61, 62 and 63. These ribs project inwardly toward the ends 26 and 27 respectively of the sheets. The ribs are parallel and the ribs 61 and 63 are arranged adjacent the side edges and are of increased depth. The ribs 61 and 63 each include a pair of slots 64 best visible in FIG. 2 which allow the edge of the mica sheet to slide into the slots and thus be housed or retained within the slots and prevented from vertical movement relative to the side wall. Thus the edge 26, 27 projects through the slot into the area behind the rib as best shown in FIG. 3. The rib 62 between the rib 61 and 63 is of reduced depth and cooperates with a notch 65 provided in the edge of the mica sheet which prevents horizontal movement of the mica sheet relative to the side wall. Thus when connected together by the elements 53, 55, the two heating element portions can simply be inserted into the area within the bracket 16 by sliding into position within the slot 64 to the position where the notch 65 cooperates with the rib 62 to hold the mica sheets in the required location.

In the alternative arrangement (not shown) one of the sheets carries both male blades and the other of the sheets carries both female receptacles of the coupling arrangement. This avoids the possibility of mistakenly connecting two sheets each having the same type of breaker.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A heating element for heating an air flow passing thereover comprising a first substrate sheet and a second substrate sheet each formed of an electrically nonconductive material and defining a first side, a second opposed side, a first side edge, a second opposed side edge, a first end and a second opposed end, each substrate sheet having wound generally therearound a continuous electrical resistance heating wire, the wire being shaped so as to form a plurality of separate generally parallel helical coils and a plurality of interconnecting portions, the helical coils including a first helical coil and a last helical coil, alternate ones of the helical coils being arranged on the first and second sides of the sheet respectively, each helical coil extending from a position adjacent the first side edge to a position adjacent the second side edge, each end of each helical coil except the first on one side of each substrate sheet and the last on the other side of each substrate sheet being connected by a respective one of the interconnecting portions to a respective corresponding end of two helical coils on the other side, connecting means for supporting the first and second substrate sheets in substantially parallel spaced generally overlying relation with the first side of the first sheet facing the first side of the second sheet such that the helical coils on the first side of the first sheet are adjacent to but spaced from the helical coils on the first side of the second sheet so as to allow the passage of the air flow therebetween, and first and second terminal means for connection to a source of electrical power, said connecting means being arranged to provide both mechanical support between the first and second sheets and also electrical connection between the heating wire of the first sheet and the heating wire of the second sheet the connecting means and The first and second terminal means being arranged such that electrical power flows through the heating wires of both of said sheets.

2. The heating element according to claim 1 wherein the connecting means comprises for each sheet a first and a second substantially rigid electrically conductive member each upstanding from the respective sheet and each connected to a respective end of the heating wire at the first and last coils respectively, the first and second members of the first sheet being attached to the second and first members respectively of the second sheet to establish electrical connection therebetween, and wherein the first and second terminal means are electrically connected to be first members of the first and second sheets respectively such that current flows through the heating coils of both sheets in parallel.

3. The heating element according to claim 2 wherein the conductive members of the first sheet are separable from and readily connectable to the members of the second sheet.

4. The heating element according to claim 3 wherein the conductive members are of the blade and socket type.

5. The heating element according to claim 3 wherein the conductive members of the first sheet include a female member and a male member and wherein the conductive members of the second sheet include a female member and a male member, the female member of one sheet being cooperable with the male member of the other sheet in a releasable and readily refastenable arrangement.

6. The heating element according to claim 5 wherein the first and second sheets are substantially symmetrical such that when the second sheet is inverted and applied on top of the first sheet the male connector of one engages onto the female connector of the other.

7. The heating element according to claim 2 wherein each of these sheets includes a thermal circuit interrupter connected between an end of the wire and a respective one of the conductive members.

8. The heating element according to claim 7 wherein the thermal circuit interrupter of the first sheet comprises a resetting thermostat and wherein thermal circuit interrupter of the second sheet comprises a fusible link.

9. The heating element according to claim 2 wherein the conductive members are arranged adjacent one side edge of the respective sheet.

10. The heating element according to claim 1 wherein the number of turns in one of the helical coils is less than the number of turns in a second of the helical coils so as to provide an increased heating effect at the second of the helical coils.

11. The heating element according to claim 10 wherein at least two helical coils with the increased number of turns are provided and are arranged respectively adjacent the ends of the sheets.

12. The heating element according to claim 1 including a support bracket for engaging and holding the sheets in the air flow, the support bracket comprising a channel member including a base extending substantially parallel to the sheets and a pair of upstanding side walls, ends of the sheets being attached to the upstanding side walls.

13. The heating element according to claim 12 wherein each side wall is formed from sheet metal deformed to provide rib members extending longitudinally of the side wall and raised so as to project inwardly of the side wall, the rib means having transverse slots formed therein for receiving the ends of the sheets.

14. The heating element according to claim 13 including a further upstanding rib means which is free from transverse slots for engaging a notch in an edge of the sheet to locate the sheet against side to side movement relative to the side wall.

15. A heater comprising a fan for generating an air flow, and a heating element mounted so as to receive the air flow passing thereover, said heating element comprising a first substrate sheet and a second substrate sheet each formed of an electrically non-conductive material and defining a first side, a second opposed side, a first side edge, a second opposed side edge, a first end and a second opposed end, each substrate sheet having wound generally therearound a continuous electrical resistance heating wire, the wire being shaped so as to form a plurality of separate generally parallel helical coils and a plurality of interconnecting portions, the helical coils including a first helical coil and a last helical alternate ones of the helical coils being arranged on the first and second sides of the sheet respectively, each helical coil extending from a position adjacent one side edge to a position adjacent the second side edge, each end of each helical coil except the first on one side of each substrate sheet and the last on the other side of each substrate sheet being connected by a respective one of the interconnecting portions to a respective corresponding end of two helical coils on the other side, first and second terminals means for connection to a source of electrical power connected to said heating wires and arranged relative thereto for effecting for transmission of a current through the heating wires of each of said sheets and connecting means for supporting the first and second substrate sheets in substantially parallel spaced generally overlying relation with the first side of the first sheet facing the first side of the second sheet such that the helical coils on the first side of the first sheet are adjacent to but spaced from the helical coils on the first side of the second sheet so as to allow the passage of the air flow therebetween, said connecting means being arranged adjacent said ends of the sheets outwardly beyond end most ones of the helical coils such that an area between the sheets at the helical coils is free from elements between the sheets causing restriction of the air flow therebetween.

16. The heater according to claim 15 wherein the connecting means is arranged to provide both mechanical support between the first and second sheets and also electrical connection between the heating wire of the first sheet and the heating wire of the second sheet, the connecting means and the first and second terminals being arranged such that electrical power flows through the heating wires of both of said sheets.

17. The heater according to claim 16 wherein the connecting means comprises for each sheet a first and a second substantially rigid electrically conductive member each upstanding from the respective sheet and each connected to a respective end of the heating wire at the first and last coils respectively, the first and second members of the first sheet being attached to the second and first members respectively of the second sheet, to establish electrical connection therebetween, and wherein the first and second terminals are electrically connected to be first members of the first and second sheets respectively such that current flows through the heating coils of both sheets in parallel.

18. The heater according to claim 15 wherein the number of turns in one of the helical coils is less than the number of turns in at least two others of the helical coils so as to provide an increased heating effect at the at least two others of the helical coils and wherein the helical coils with the increased number of turns are arranged respectively adjacent the ends of the sheets.

19. The heater according to claim 15 including a support bracket for engaging and holding the sheets in the air flow, the support bracket comprising a channel member including a base extending substantially parallel to the sheets and a pair of upstanding side walls, ends of the sheets being attached to the upstanding side walls and wherein each side wall is formed from sheet metal deformed to provide rib members extending longitudinally of the side wall and raised so as to project inwardly of the side wall, the rib means having transverse slots formed therein for receiving the ends of the sheets.

20. The heater according to claim 19 including a further upstanding rib means which is free from transverse slots for engaging a notch in an edge of the sheet to locate the sheet against side to side movement relative to the side wall.

* * * * *